US009243807B2

(12) United States Patent
Chilton et al.

(10) Patent No.: US 9,243,807 B2
(45) Date of Patent: Jan. 26, 2016

(54) OVEN APPLIANCE

(71) Applicant: General Electric Company, Schenectady, NY (US)

(72) Inventors: John Mark Chilton, Campbellsburg, KY (US); Stephen Bernard Froelicher, Shepherdsville, KY (US); Scott Thomas Kershner, La Grange, KY (US); Joshua Stephen Wiseman, Elizabethtown, KY (US); John Adam Yantis, Prospect, KY (US)

(73) Assignee: General Electric Company, Schenectady, NY (US)

( * ) Notice: Subject to any disclaimer, the term of this patent is extended or adjusted under 35 U.S.C. 154(b) by 178 days.

(21) Appl. No.: 13/790,171

(22) Filed: Mar. 8, 2013

(65) Prior Publication Data

US 2014/0251300 A1 Sep. 11, 2014

(51) Int. Cl.
*F24C 15/02* (2006.01)

(52) U.S. Cl.
CPC ..... *F24C 15/021* (2013.01)

(58) Field of Classification Search
CPC ..... E06B 7/232; F24C 15/02; A47L 15/4263
USPC ..... 126/192, 190
See application file for complete search history.

(56) References Cited

U.S. PATENT DOCUMENTS

| | | | | | |
|---|---|---|---|---|---|
| 1,841,868 | A * | 1/1932 | Wuebling | 49/366 |
| 2,264,634 | A * | 12/1941 | Goellner | 49/489.1 |
| 2,860,026 | A * | 11/1958 | Long | 312/296 |
| 3,409,003 | A | 11/1968 | Rehberg et al. | |
| 4,720,936 | A * | 1/1988 | Ellingson | 49/480.1 |
| 5,095,657 | A * | 3/1992 | Marsh | 49/492.1 |
| 5,603,810 | A * | 2/1997 | Michler | 202/248 |
| 7,814,897 | B2 * | 10/2010 | Larsen | 126/191 |
| 2010/0101555 | A1 * | 4/2010 | Yamaguchi et al. | 126/190 |
| 2011/0186029 | A1 * | 8/2011 | Swayze et al. | 126/190 |

* cited by examiner

*Primary Examiner* — Alissa Tompkins
*Assistant Examiner* — Rabeeul Zuberi
(74) *Attorney, Agent, or Firm* — Dority & Manning, P.A.

(57) ABSTRACT

An oven appliance is provided. The oven appliance includes a pair of doors and a pair of flanges. Each flange of the pair of flanges is mounted to a respective one of the pair of doors. The flanges engage and overlap each other when the pair of doors is in a closed position and include features for limiting wear between the flanges.

12 Claims, 7 Drawing Sheets

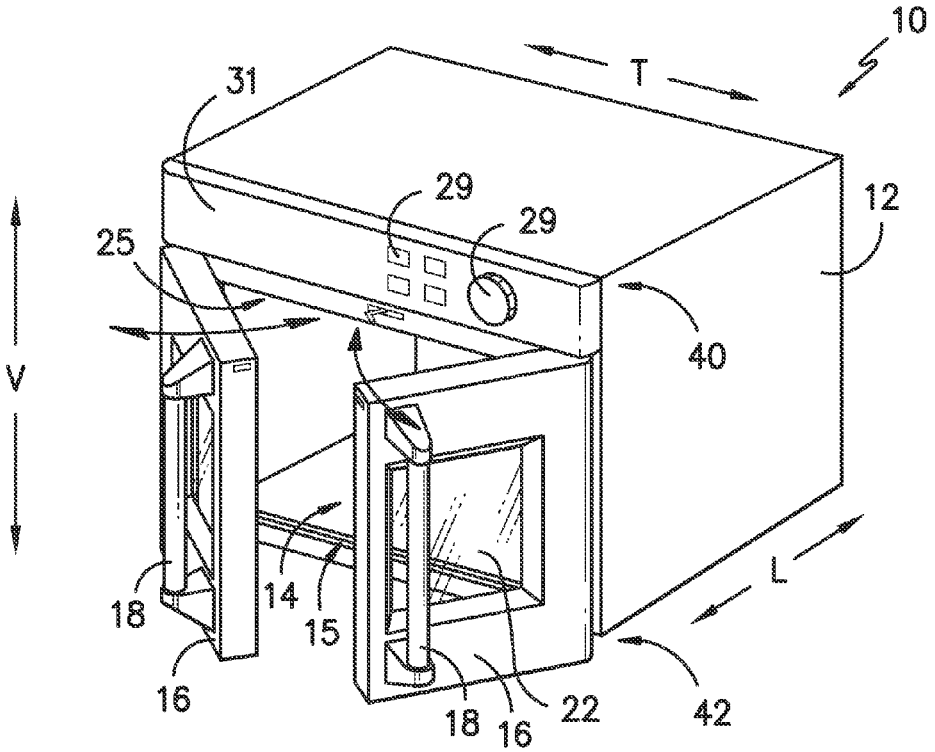
FIG. —1—
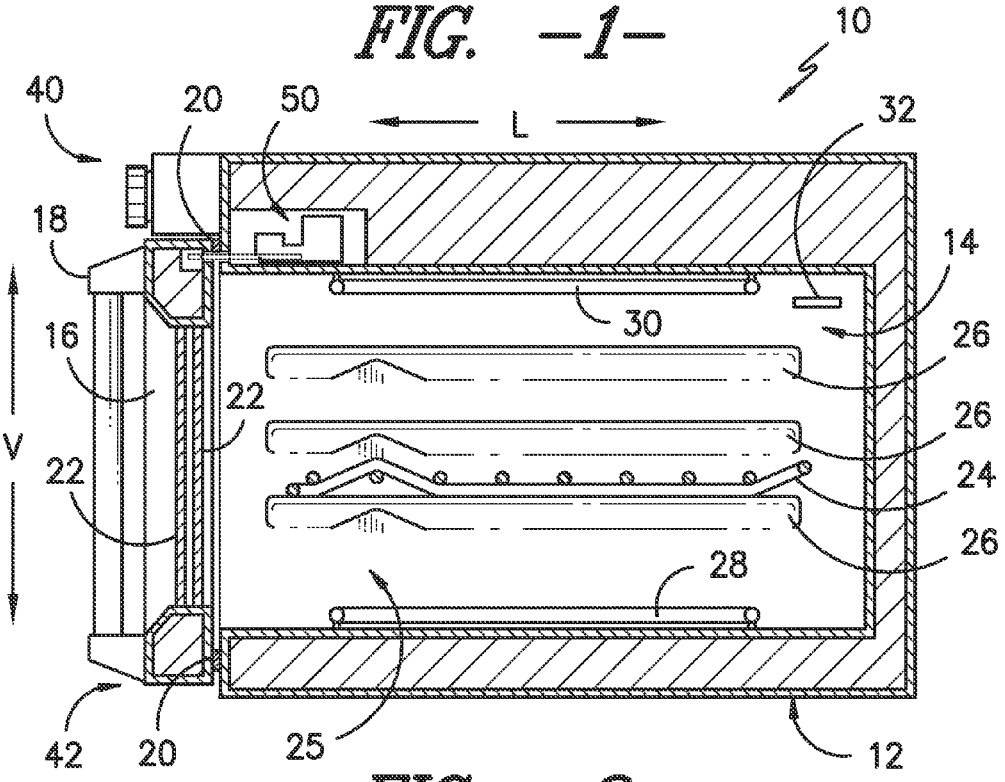
FIG. —2—

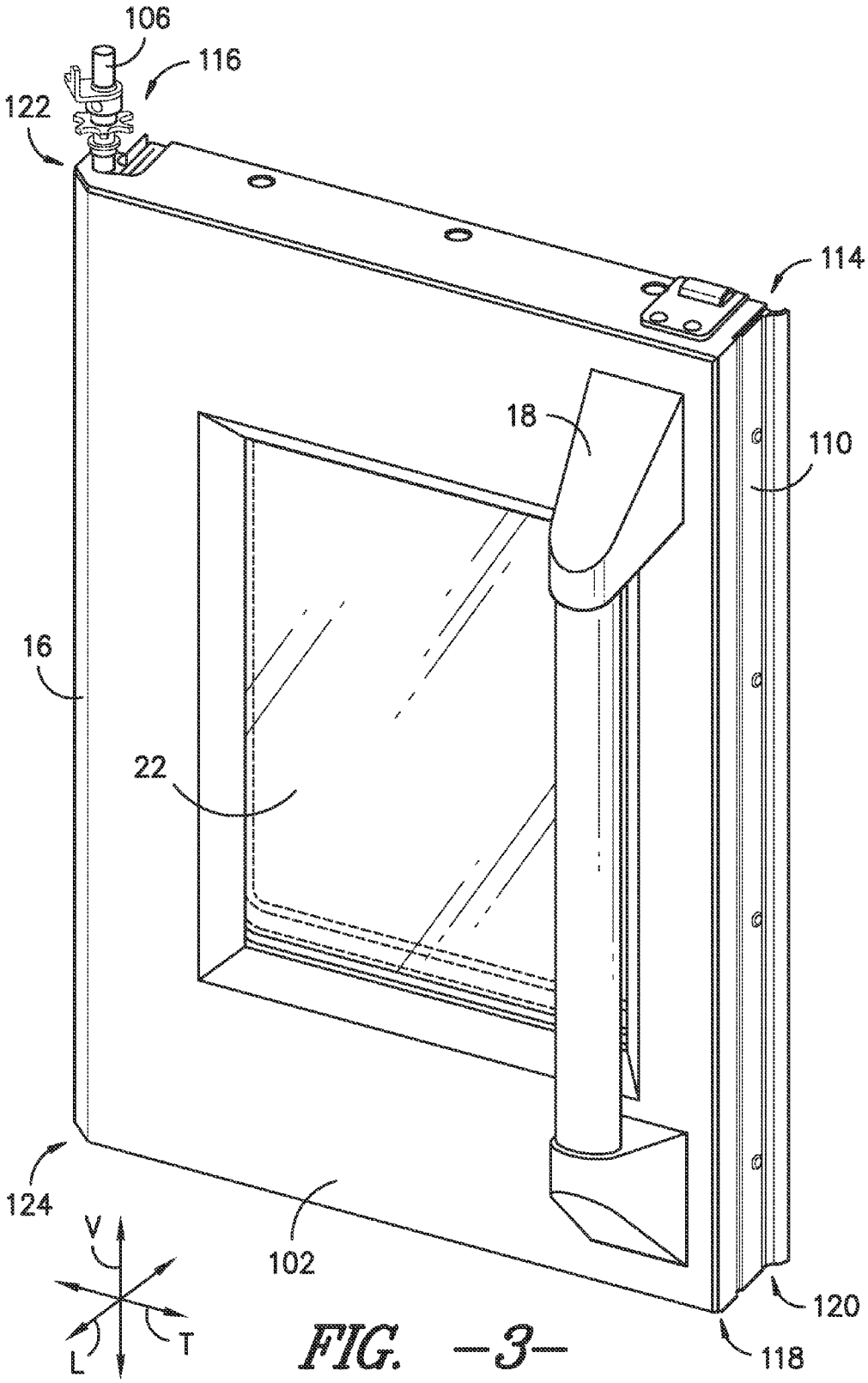
FIG. —3—

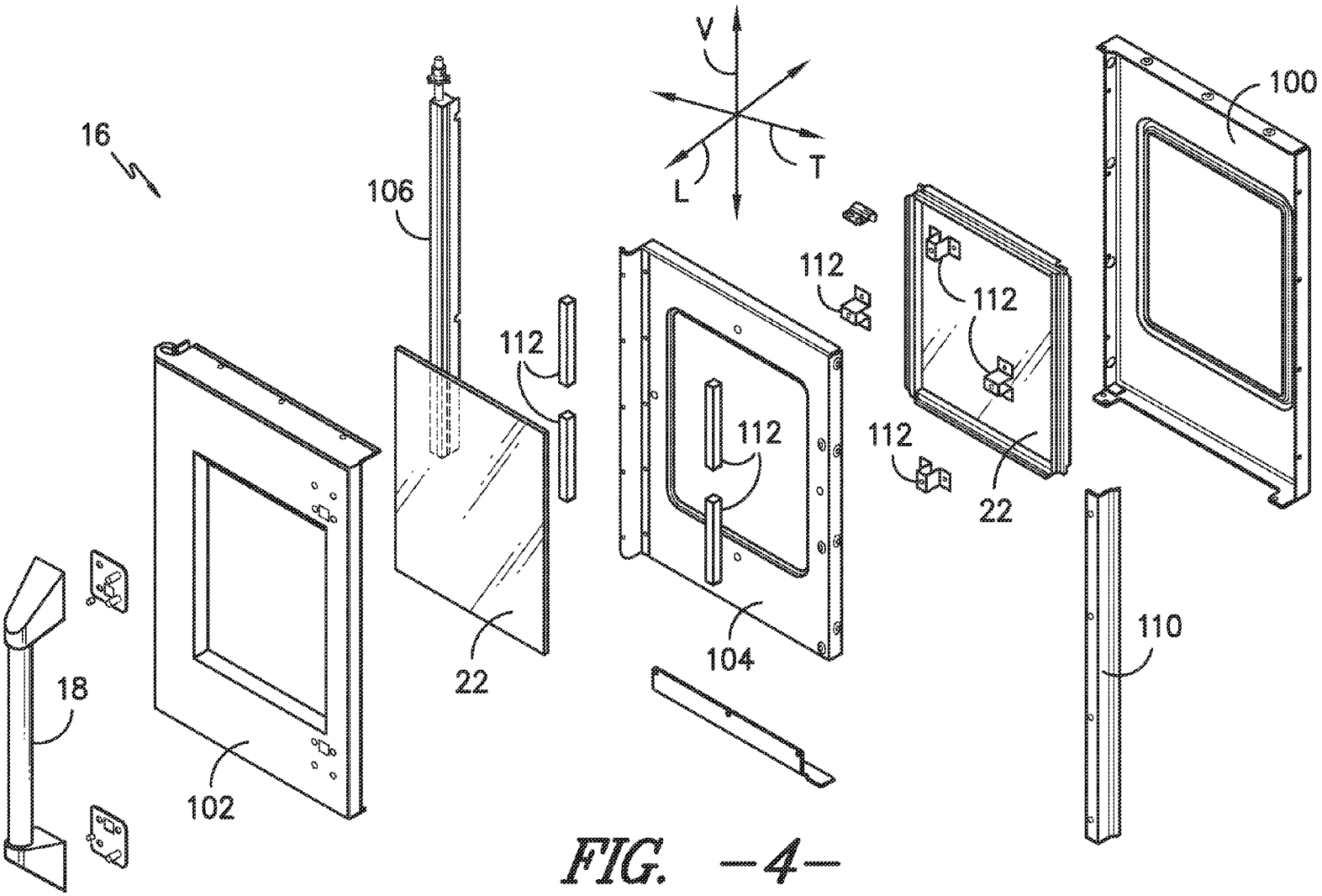
FIG. —4—

FIG. —6—

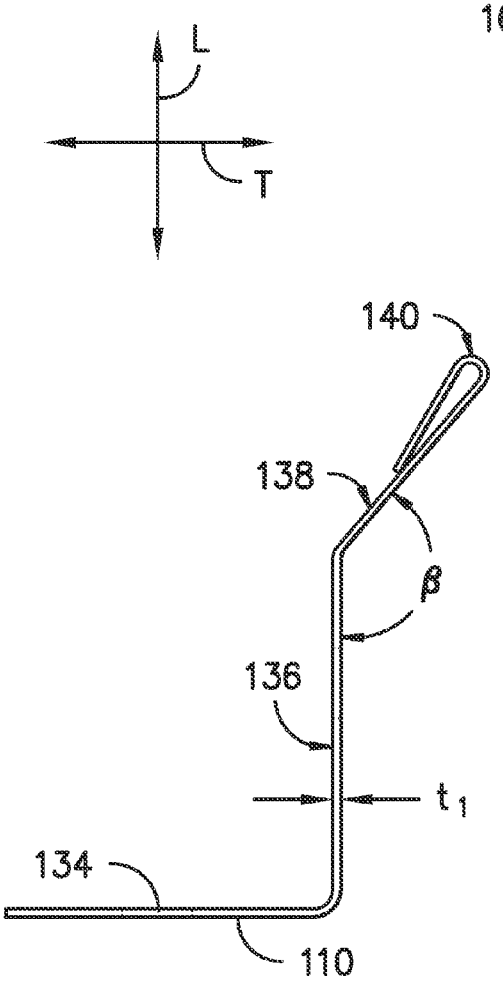
FIG. —8—
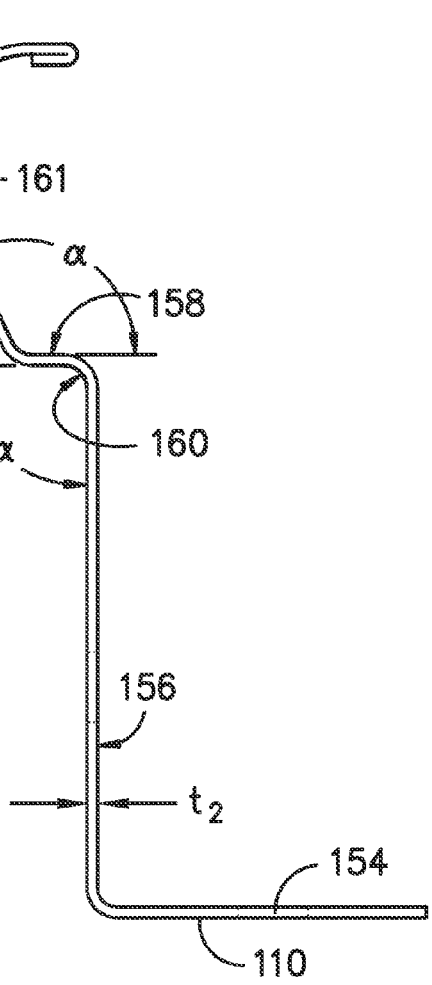
FIG. —9—

OVEN APPLIANCE

FIELD OF THE INVENTION

The present subject matter relates generally to oven appliances, such as French door oven appliances.

BACKGROUND OF THE INVENTION

Oven appliances generally include a cabinet that defines a cooking chamber for receipt of food articles for cooking. The cabinet can also define an opening for accessing the cooking chamber. Certain oven appliances include a pair of doors rotatably mounted to the cabinet at the opening to permit selective access to the cooking chamber through the opening. Oven appliances having such doors are generally referred to as French door style oven appliances.

French door style oven appliances generally include flanges between the doors that overlap each other when the doors are closed. The flanges can limit heat loss through a gap between the doors. Flanges generally contact and slide against each other during opening and closing of the oven appliance's doors. Such contact and rubbing can cause wear damage, such as galling and gouging, on the flanges and negatively affect the flanges' cosmetic appearance and/or function.

In addition, during opening and closing of the doors, one door is preferably closed prior to the other door such that the flanges properly overlap when both doors are closed. To assist proper positioning of doors, certain oven appliances include a linkage system that couples the doors together such that rotational motion is transferred between the doors. Thus, if one door is rotated then the linkage assembly can cause the other door to rotate as well. However, such linkage assemblies generally have a significant amount of slop or play such that the doors can become misaligned during opening and closing. In particular, the leading door can fall behind the trailing door, and such misalignment can cause the flanges to impact and prevent the doors from properly closing.

Accordingly, an oven appliance having an improved interface between a pair of doors when the doors are in a closed position would be useful. In particular, an oven appliance having features for limiting or hindering wear between flanges of a pair of doors of the oven appliance would be useful. In addition, an oven appliance having features for limiting or hindering misalignment between flanges of a pair of doors of the oven appliance would be useful.

BRIEF DESCRIPTION OF THE INVENTION

The present subject matter provides an oven appliance. The oven appliance includes a pair of doors and a pair of flanges. Each flange of the pair of flanges is mounted to a respective one of the pair of doors. The flanges engage and overlap each other when the pair of doors is in a closed position and include features for limiting wear between the flanges. Additional aspects and advantages of the invention will be set forth in part in the following description, or may be apparent from the description, or may be learned through practice of the invention.

In a first exemplary embodiment, an oven appliance is provided. The oven appliance defines a vertical direction and a transverse direction. The vertical and transverse directions are perpendicular to each other. The oven appliance includes a cabinet that defines a chamber for receipt of food items for cooking. The cabinet also defines an opening. The chamber of the cabinet is accessible through the opening of the cabinet.

The oven appliance also includes a heating element for providing heat to food items in the chamber of the cabinet. A first door is rotatably mounted proximate the opening of the cabinet. A first flange is mounted to the first door. The first flange has a first portion positioned at the first door and a second portion that extends away from the first door such that a distal end portion of the second portion of the first flange is spaced apart from the first door along the transverse direction. A second door is also rotatably mounted proximate the opening of the cabinet. A second flange is mounted to the second door. The second flange has a first portion positioned at the second door and a second portion extending away from the second door along the transverse direction. The distal end portion of the first flange received between the first and second portions of the second flange when the first and second doors are in a closed position.

In a second exemplary embodiment, an oven appliance is provided. The oven appliance defines a vertical direction and a transverse direction. The vertical and transverse directions are perpendicular to each other. The oven appliance includes a cabinet that defines a chamber for receipt of food items for cooking. The cabinet also defines an opening for permitting access to the chamber of the cabinet. The oven appliance also includes a heating element for providing heat to food items in the chamber of the cabinet. A pair of doors is mounted proximate the opening of the cabinet. The oven appliance further includes a pair of flanges. The pair of flanges includes a first flange and a second flange that engage and overlap each other when the pair of doors is in a closed position. The first flange and the second flange are each mounted to a respective one of the pair of doors. The first and second flanges each have a different hardness.

In a third exemplary embodiment, an oven appliance is provided. The oven appliance defines a vertical direction and a transverse direction. The vertical and transverse directions are perpendicular to each other. The oven appliance includes a cabinet that defines a chamber for receipt of food items for cooking. The cabinet also defines an opening for permitting access to the chamber of the cabinet. The oven appliance also includes a heating element for providing heat to food items in the chamber of the cabinet. A pair of doors is mounted proximate the opening of the cabinet. The oven appliance further includes a pair of flanges. The pair of flanges includes a first flange and a second flange that engage and overlap each other when the pair of doors is in a closed position. The first flange and the second flange are each mounted to a respective one of the pair of doors. The first and second flanges each have a different thickness.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 1 provides a front, perspective view of an oven appliance according to an exemplary embodiment of the present subject matter.

FIG. 2 provides a side, section view of the oven appliance of FIG. 1.

FIG. 3 provides a front, perspective view of a door of the oven appliance of FIG. 1.

FIG. 4 provides an exploded view of the door of FIG. 3.

FIGS. 8 and 9 provide top, plan views of flanges of the doors of FIG. 6.

DETAILED DESCRIPTION

Figure 5:
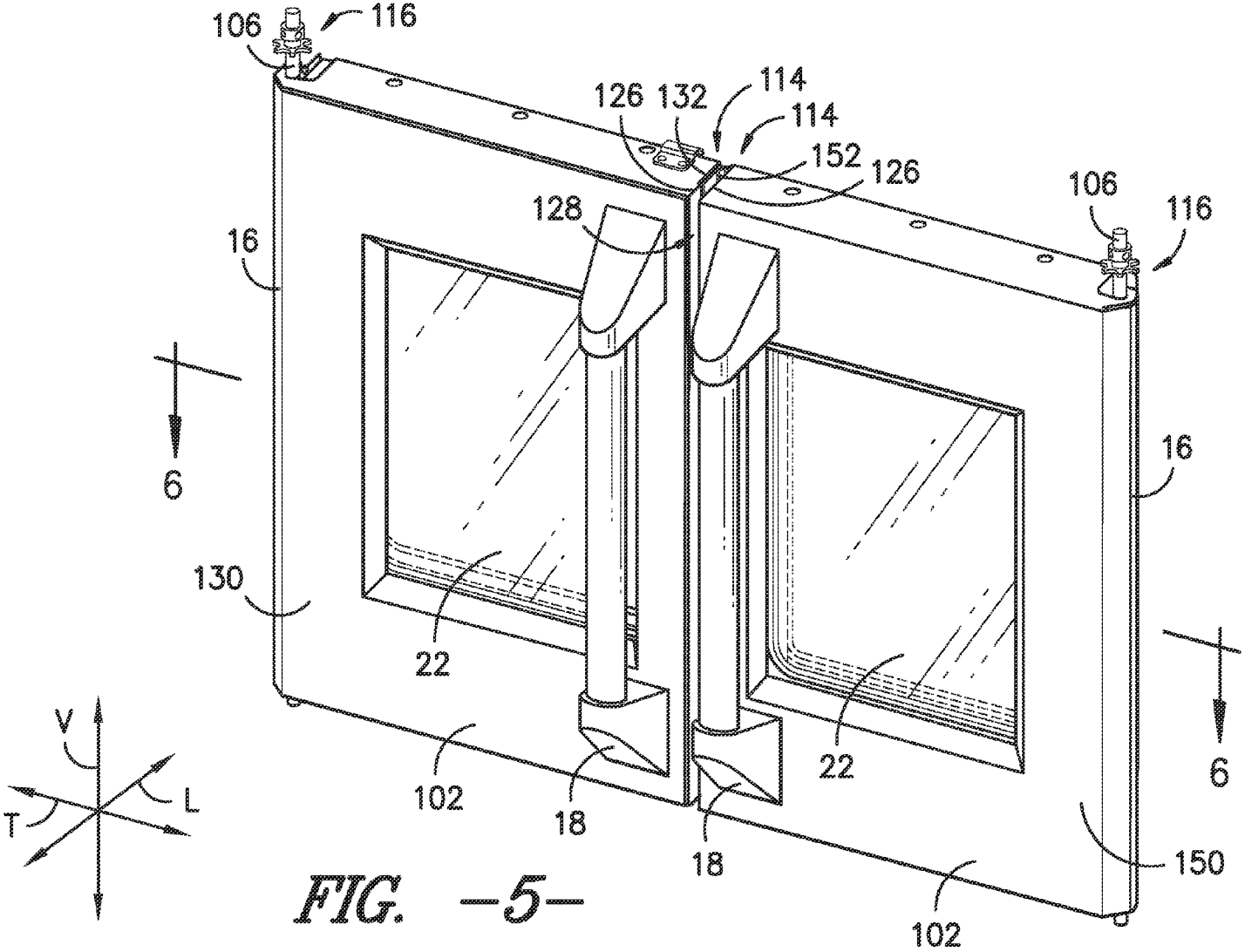
FIG. 5 provides a front, perspective view of a pair of doors of the oven appliance of FIG. 1.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIGS. 1 and 2 illustrate an oven appliance 10 according to an exemplary embodiment of the present subject matter. Oven appliance 10 includes an insulated cabinet 12 with an interior surface 25 that defines a cooking chamber 14. Cooking chamber 14 is configured for the receipt of one or more food items to be cooked.

Cabinet 12 extends between a top 40 and a bottom 42 along a vertical direction V. Cabinet 12 also defines a lateral direction L and a transverse direction T. The vertical, lateral, and transverse directions V, L, and T are mutually perpendicular and form an orthogonal direction system.

Oven appliance 10 also includes a pair of doors 16 rotatably mounted on cabinet 12 proximate an opening 15 to chamber 14 defined by cabinet 12. Thus, oven appliance 10 is sometimes referred to as a French door style oven appliance. Doors 16 are configured for selectively shifting between an open position or configuration shown in FIG. 1 in which a user can access cooking chamber 14 and a closed position or configuration shown in FIG. 2 in which the user is impeded from accessing cooking chamber 14 by doors 16. Handles 18 are attached to doors 16 and assist with shifting doors 16 between the open and closed positions.

One or more gaskets 20 between doors 16 and cabinet 12 provide for maintaining heat and cooking fumes within chamber 14 when doors 16 are in the closed position as shown in FIG. 2. Glass panes 22 provide for viewing the contents of chamber 14 when doors 16 are in the closed position as well as providing insulation between chamber 14 and the exterior of oven appliance 10. A rack 24 is positioned in chamber 14 for the receipt of food items. Rack 24 is slidably received onto ribs/rails 26 such that rack 24 may be conveniently moved into and out of chamber 14 when doors 16 are open. Multiple rails 26 are provided so that the height of rack 24 may be adjusted.

Heating elements 28 and 30 are positioned within chamber 14 of cabinet 12. Heating elements 28 and 30 are used to heat chamber 14 for both cooking and cleaning of oven appliance 10. While electrically-resistive heating elements 28 and 30 are shown, the present subject matter may be used with other heating elements as well such as gas burners or microwave elements.

The operation of oven appliance 10 including heating elements 28 and 30 is controlled by one or more processing devices (not shown) such as a microprocessor other device that is in communication with such components. User manipulated controls 29 on control panel 31 allow the user to make selections regarding temperature, time, and other options. The selections can be communicated to the processing device for operation of oven appliance 10. Such processing device is also in communication with a temperature sensor 32 that is used to measure temperature inside chamber 14. Although only one temperature sensor 32 is shown, it should be understood that multiple sensors can be placed within oven appliance 10 for determining the oven temperature.

Oven appliance 10 is provided by way of example only. Thus, the present subject matter may be used in any other suitable oven appliance configuration. For example, the present subject matter may be used in oven range appliances or in oven appliances that define multiple interior cavities for the receipt of food and/or have different pan or rack arrangements than the exemplary embodiment shown in FIG. 2. Heating elements at the top, back, or sides of chamber 14 may also be provided, and a variety of different types of heating elements such as microwave, halogen, gas fuel, electrical resistance, and combinations thereof may be used. Other configurations may also be used as will be understood by one of skill in the art using the teachings disclosed herein.

As may be seen in FIG. 2, oven appliance 10 includes a lock assembly 50. Lock assembly 50 is configured for selectively securing doors 16 in the closed position. For example, during a cleaning cycle of oven appliance 10, cooking chamber 14 and heating elements 28, 30 can reach high temperatures. Lock assembly 50 can secure doors 16 in the closed position during the cleaning cycle, e.g., in order to prevent the user from opening doors 16 and accessing cooking chamber 14.

FIG. 3 provides a perspective view of one of doors 16 of oven appliance 10. FIG. 4 provides an exploded view of the one of doors 16. As may be seen in FIG. 3, door 16 extends between a first side portion 114 and a second side portion 116, e.g., along the transverse direction T. Thus, first and second side portions 114 and 116 can be spaced apart from each other along the transverse direction T and positioned on opposite transverse sides of door 16. Door 16 also extends between an exterior portion 118 and an interior portion 120, e.g., along the lateral direction L. Thus, exterior and interior portions 118 and 120 can be spaced apart from each other along the lateral direction L and positioned on opposite lateral sides of door 16. Door 16 further extends between a top portion 122 and a bottom portion 124, e.g., along the vertical direction V. Thus, top and bottom portions 122 and 124 can be spaced apart from each other along the vertical direction V and positioned on opposite vertical sides of door 16.

As may be seen in FIG. 4, door 16 includes an outer door panel 102, e.g., positioned at exterior portion 118 of door 16, and an inner door panel 100, e.g., positioned at interior portion 120 of door 16. Inner door panel 100 is spaced apart from outer door panel 102, e.g., in the lateral direction L. Door 16 also includes insulation 104 disposed between inner and outer door panels 100 and 102, e.g., along the lateral direction L. Insulation 104 can assist with hindering or limiting heat transfer between inner and outer door panels 100 and 102. Door 16 also includes a hinge 106 for rotatably mounting door 16 to cabinet 12 (FIG. 1). Door 16 further includes spacers 112 for assisting with arranging or spacing inner door panel 100, outer door panel 102, insulation 104, and/or glass panes 22 apart from one another, e.g., along the lateral direction L.

FIG. 5 provides a perspective view of doors 16 of oven appliance 10 (FIG. 1). Doors 16 include a first door 130 and a second door 150. As may be seen in FIG. 5, each door of doors 16 has a sidewall 126, e.g., positioned at first side portions 114 of doors 16. In particular, first door 130 has a sidewall 132, and second door 150 has a sidewall 152. Sidewall 152 of second door 150 is positioned proximate sidewall 132 of first door 130 when first and second doors 130 and 150 are in the closed position such that sidewalls 126 define a gap 128 therebetween.

As will be understood by those skilled in the art, if heated air escapes cooking chamber 14 through gap 128 between doors 16, performance of oven appliance 10 can be negatively affected and exterior portion 118 of doors 16, e.g., adjacent gap 128, can also be heated. Thus, doors 16 include features for hindering or limiting a flow of heated air from cooking chamber 14 through gap 128.

Figure 6:
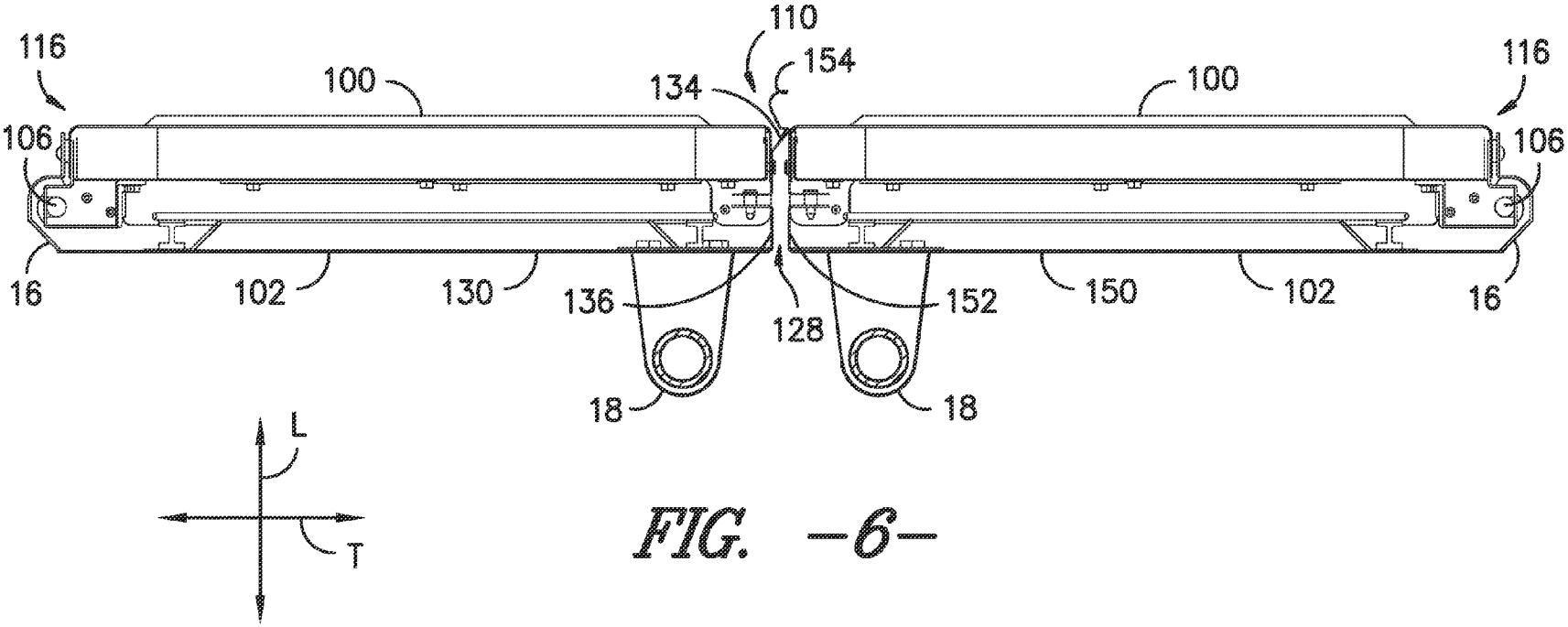
FIG. 6 provides a section view of the doors of FIG. 5 taken along the 6-6 line of FIG. 5.
Figure 7:
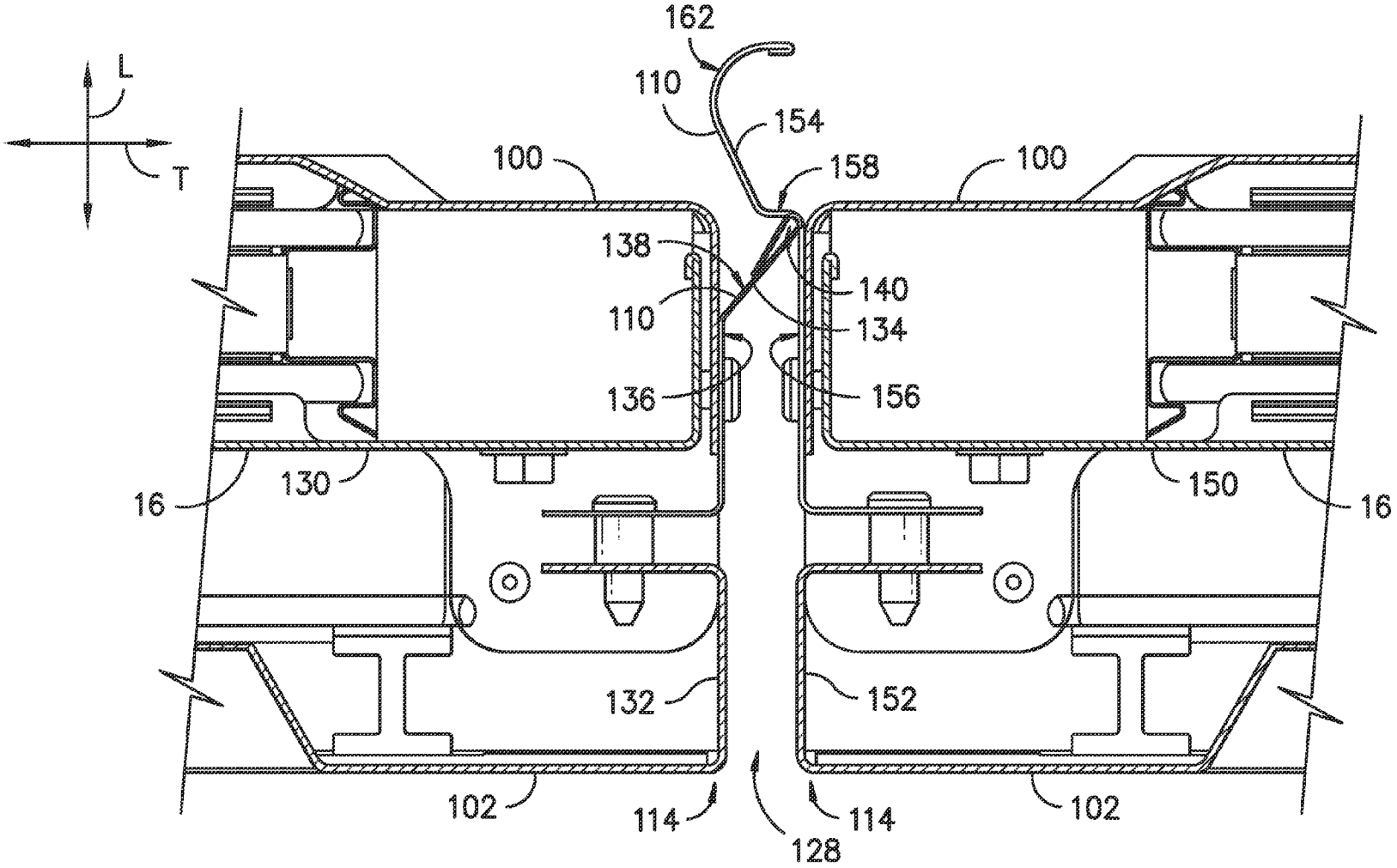
FIG. 7 provides a partial section view of the doors of FIG. 6.

FIG. 6 provides a section view of doors 16 taken along the 6-6 line of FIG. 5. FIG. 7 provides a partial section view of doors 16. As may be seen in FIGS. 6 and 7, oven appliance 10 includes a pair of seals or flanges 110. Each flange of flanges 110 is mounted to a respective one of doors 16, e.g., at sidewalls 126 of doors 16. In particular, flanges 110 include a first flange 134 mounted to first door 130, e.g., at sidewall 132 of first door 130, and a second flange 154 mounted to second door 150, e.g., at sidewall 152 of second door 150. Flanges 110 extend into gap 128 and, e.g., hinder heated air from escaping cooking chamber 14. In particular, flanges 110 engage and overlap each other when doors 16 are in a closed position and are positioned within gap 128.

FIGS. 8 and 9 provide top, plan views of flanges 110 of doors 16. As may be seen in FIG. 8, first flange 134 has a first portion 136. First portion 136 of first flange 134 may be positioned at or mounted to first door 130. In particular, first portion 136 of first flange 134 may be mounted to first door 130 at sidewall 132 of first door 130. First flange 134 also includes a second portion 138 having a distal end portion 140. Distal end portion 140 is spaced apart from first portion 136 of first flange 134, e.g., along the transverse direction T. Turning back to FIG. 7, second portion 138 of first flange 134 extends away from first door 130 such that distal end portion 140 of second portion 138 of first flange 134 is spaced apart from first door 130 along the transverse direction T.

Second portion 138 of first flange 134 includes a teardrop hem at distal end portion 140 of first flange 134. Further, first and second portions 136 and 138 of first flange 134 define an angle, β, therebetween, e.g., in a plane that is perpendicular to the vertical direction V. Angle β can be any suitable angle. For example, angle β may be about one-hundred and forty degrees or greater than about one-hundred and twenty degrees and less than about one-hundred and sixty degrees.

As may be seen in FIG. 8, second flange 154 has a first portion 156. First portion 156 of second flange 154 may be positioned at or mounted to second door 150. In particular, first portion 156 of second flange 154 may be mounted to second door 150 at sidewall 152 of second door 150. Turning back to FIG. 7, second portion 158 of second flange 154 extends away from second door 150, e.g., along the transverse direction T. First and second portions 156 and 158 of second flange 154 define a landing 160 therebetween.

First and second portions 156 and 158 of second flange 154 define an angle, α, therebetween, e.g., in a plane that is perpendicular to the vertical direction V. Angle α can be any suitable angle. For example, angle α may be about ninety degrees or greater than about eighty degrees and less than about one-hundred degrees. Second flange 154 also includes a third portion 162 mounted to second portion 158 of second flange 154, e.g., with a fourth portion 161. Fourth portion 161 of second flange 150 can be substantially linear and extend between and connect third portion 162 of second flange 150 with second portion 158 of second flange 150. Third portion 162 has a substantially arcuate shape, e.g., in a plane that is perpendicular to the vertical direction V.

Second and fourth portions 158 and 161 of second flange 154 define an angle δ therebetween, e.g., in a plane that is perpendicular to the vertical direction V. Angle δ can be any suitable angle. For example, angle δ may be about sixty-five degrees, greater than about sixty degrees and less than about seventy degrees, or greater than about fifty degrees and less than about eighty degrees.

As may be seen in FIG. 7, distal end portion 140 of first flange 134 is received between first and second portions 156 and 158 of second flange 154 when first and second doors 130 and 150 are in the closed position. In particular, distal end portion 140 of first flange 134 is positioned at landing 160 of second flange 154 when first and second doors 130 and 150 are in the closed position. In such a manner, first and second flanges 134 and 154 can assist with hindering the flow of heated air out of cooking chamber 14 of cabinet 12 (FIG. 2) through gap 128 when first and second doors 130 and 150 are in the closed position.

Further, first and second flanges 134 and 154 can assist with properly positioning first and second doors 130 and 150 in the closed position. For example, by positioning distal end portion 140 of first flange 134 at landing 160 of second flange 154, first and second flanges 134 and 154 can engage each other at a consistent location. Further, first and second doors 130 and 150 may not close properly if second door 150 is placed in the closed position prior to first door 130. As will be understood by those skilled in the art, oven appliance 10 can include a mechanism for transferring rotational motion between first and second doors 130 and 150, e.g., such that first and second doors 130 and 150 open and close simultaneously. Such mechanisms can have a certain amount of play such that second door 150 can lead first door 130 as first and second doors 130 and 150 approach the closed position. However, distal end portion 140 of first flange 134 can impact and slide on third portion 162 of second flange 154 in order to assist with properly positioning first and second doors 130 and 150 in the closed position and hinder or prevent second door 150 from obstructing first door 130 as first and second doors 130 and 150 approach the closed position.

First and second flanges 134 and 154 also include features for limiting or reducing wear damage between first and second flanges 134 and 154. For example, first flange 134 may be constructed with a first material. Conversely, second flange 154 may be constructed with a second material. The first and second materials can be different from each other. For example, the first and second materials can be two different grades of the same material or be two different types of material. As discussed in greater detail below, the first and second materials also can each have a different hardness and/or thickness in order to limit or reduce wear damage between first and second flanges 134 and 154.

The first material can be any suitable material, such as Type 301, half hard stainless steel having a hardness level between about C30 Rockwell and about C40 Rockwell. The second material can also be any suitable material, such as Type 304 stainless steel having a hardness level between about 140 Brinell and about 255 Brinell. Thus, the first material may have a hardness that is less than a hardness of the second material such that first flange 134 is constructed with a softer material than second flange 154. In such a manner, wear damage between first and second flanges 134 and 154 can be limited or reduced.

Further, the first material can have a thickness, $t_1$, and the second material can have a second thickness, $t_2$. As an example, first flange 134 may be constructed with sheet metal of the first material having thickness $t_1$ and bent or otherwise manufactured into the shape shown in FIG. 8, and second flange 136 may be constructed with sheet metal of the second material having thickness $t_2$ and bent or otherwise manufactured into the shape shown in FIG. 9. Thickness $t_1$ may be less than thickness $t_2$, e.g., such that first flange 134 is more flexible than second flange 154. Thicknesses $t_1$ and $t_2$ can be any suitable thickness. For example, thickness $t_1$ may be between about one-hundredth of an inch and about fifteen thousandths of an inch, and thickness $t_2$ may be between about twenty-four thousandths of an inch and about three hundredths of an inch. In such a manner, wear damage between first and second flanges 134 and 154 can be limited or reduced.

In certain exemplary embodiments, distal end portion 140, e.g., teardrop hem at distal end portion 140, can have a radius, and landing 160 can also have a radius. The radius of distal end portion 140 and the radius of landing 160 can be any suitable radii. In certain exemplary embodiments, the radius of distal end portion 140 is different than the radius of landing 160. For example, the radius of distal end portion 140 may be about four hundredths of an inch. Conversely, the radius of landing 160 may be about twenty-four thousandths of an inch. Thus, the radius of distal end portion 140 may be greater than the radius of landing 160.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance, the oven appliance defining a vertical direction and a transverse direction, the vertical and transverse directions being perpendicular to each other, the oven appliance comprising:

a cabinet defining a chamber for receipt of food items for cooking, said cabinet also defining an opening, the chamber of said cabinet being accessible through the opening of said cabinet;

a heating element for providing heat to food items in the chamber of said cabinet;

a first door rotatably mounted proximate the opening of said cabinet;

a first flange formed of bent sheet metal, said first flange mounted to said first door, said first flange having a first portion positioned at said first door and a second portion extending away from said first door such that a distal end portion of the second portion of said first flange is spaced apart from said first door along the transverse direction, the first and second portions of said first flange defining an angle, $\beta$, therebetween in a plane that is perpendicular to the vertical direction, $\beta$ being no less than one-hundred and twenty degrees and no greater than one-hundred and sixty degrees;

a second door rotatably mounted proximate the opening of said cabinet; and a second flange formed of bent sheet metal, said second flange mounted to said second door, said second flange having a first portion positioned at said second door and a second portion extending away from said second door along the transverse direction, the first and second portions of said second flange defining an angle $\alpha$, therebetween in a plane that is perpendicular to the vertical direction, $\alpha$ being no less than eighty degrees and no greater than one-hundred degrees, the distal end portion of said first flange received between the first and second portions of said second flange when said first and second doors are in a closed position, said second flange also having a third portion mounted to the second portion of said second flange, the third portion having a substantially arcuate shape in a plane that is perpendicular to the vertical direction, wherein the first flange is constructed with a first metal and said second flange is constructed with a second metal, the first metal having a hardness that is less than a hardness of the second metal.

2. The oven appliance of claim 1, wherein said first flange is constructed with a first metal and said second flange is constructed with a second metal, the first metal having a thickness that is less than a thickness of the second metal.

3. The oven appliance of claim 1, wherein the first and second portion of said second flange define a landing therebetween, the distal end portion of said first flange positioned at the landing of said second flange when said first and second doors are in the closed position.

4. The oven appliance of claim 3, wherein the second portion of said first flange includes a teardrop hem at the distal end portion of said first flange.

5. The oven appliance of claim 1, wherein said first and second door each include a sidewall, the sidewall of said second door positioned proximate the sidewall of said first door when said first and second doors are in the closed position, the first portion of said first flange mounted to the sidewall of said first door and the first portion of said second flange mounted to the sidewall of said second door.

6. The oven appliance of claim 1, wherein said first and second door each include a sidewall, the sidewalls of said first and second doors defining a gap therebetween when said first and second doors are in the closed position, said first flange engaging said second flange in order to hinder a flow of heated air out of the chamber of said cabinet when said first and second doors are in the closed position.

7. An oven appliance, the oven appliance defining a vertical direction and a transverse direction, the vertical and transverse directions being perpendicular to each other, the oven appliance comprising:

a cabinet defining a chamber for receipt of food items for cooking, said cabinet also defining an opening for permitting access to the chamber of said cabinet;

a heating element for providing heat to food items in the chamber of said cabinet;

a pair of doors mounted proximate the opening of said cabinet; and a pair of flanges including a first flange and a second flange that engage and overlap each other when said pair of doors is in a closed position, the first flange and the second flange each formed of bent sheet metal and mounted to a respective one of said pair of doors, the sheet metal of the first and second flanges each having a different hardness, wherein the first flange of said pair of flanges comprises a first portion mounted to the respective one of said pair of doors and a second portion that extends away from the respective one of said pair of doors along the transverse direction, the second flange of said pair of flanges comprising a first portion mounted to the respective one of said pair of doors and a second portion that extends away from the respective one of said pair of doors along the transverse direction, the first and second portions of said second flange defining an angle α, therebetween in a plane that is perpendicular to the vertical direction, α being no less than eighty degrees and no greater than one-hundred degrees, the first and second portions of said first flange defining an angle, β, therebetween in a plane that is perpendicular to the vertical direction, β being no less than one-hundred and twenty degrees and no greater than one-hundred and sixty degrees, the second flange also having a third portion mounted to the second portion of said second flange, the third portion having a substantially arcuate shape in a plane that is perpendicular to the vertical direction, wherein the first flange is constructed with a first metal and said second flange is constructed with a second metal, the first metal having a hardness that is less than a hardness of the second metal.

8. The oven appliance of claim 7, wherein the second portion of the first flange includes a teardrop hem at a distal end portion of the second portion of the first flange.

9. The oven appliance of claim 7, wherein each door of said pair of doors includes a sidewall, the sidewalls of said pair of doors positioned proximate each other when said pair of doors is in the closed position, the first portions of the first and second flanges each mounted to a respective sidewall of the pair of doors.

10. The oven appliance of claim 7, wherein each door of said pair of doors includes a sidewall, the sidewalls of said pair of doors defining a gap therebetween when said pair of doors is in the closed position, the first flange engaging the second flange in order to hinder a flow of heated air out of the chamber of said cabinet when said pair of doors is in the closed position.

11. The oven appliance of claim 7, wherein the first and second flanges each have a different thickness.

12. An oven appliance, the oven appliance defining a vertical direction and a transverse direction, the vertical and transverse directions being perpendicular to each other, the oven appliance comprising:

a cabinet defining a chamber for receipt of food items for cooking, said cabinet also defining an opening for permitting access to the chamber of said cabinet;

a heating element for providing heat to food items in the chamber of said cabinet;

a pair of doors mounted proximate the opening of said cabinet; and a pair of flanges including a first flange and a second flange that engage and overlap each other when said pair of doors is in a closed position, the first flange and the second flange each formed of bent sheet metal and mounted to a respective one of said pair of doors, the sheet metal of the first and second flanges each having a different thickness, wherein the first flange of said pair of flanges comprises a first portion mounted to the respective one of said pair of doors and a second portion that extends away from the respective one of said pair of doors along the transverse direction, the second flange of said pair of flanges comprising a first portion mounted to the respective one of said pair of doors and a second portion that extends away from the respective one of said pair of doors along the transverse direction, the first and second portions of said second flange defining an angle α, therebetween in a plane that is perpendicular to the vertical direction, α being no less than eighty degrees and no more than one-hundred degrees, the first and second portions of said first flange defining an angle, β, therebetween in a plane that is perpendicular to the vertical direction, β being no less than one-hundred and twenty degrees and no, more than one-hundred and sixty degrees, the second flange also having a third portion mounted to the second portion of said second flange, the third portion having a substantially arcuate shape in a plane that is perpendicular to the vertical direction, wherein the first flange is constructed with a first metal and said second flange is constructed with a second metal, the first metal having a hardness that is less than a hardness of the second metal.

* * * * *